US011517040B2

(12) United States Patent
Nakano et al.

(10) Patent No.: US 11,517,040 B2
(45) **Date of Patent: *Dec. 6, 2022**

(54) FLAVOR INHALER AND METHOD OF MANUFACTURING COMBUSTION TYPE HEAT SOURCE

(71) Applicant: JAPAN TOBACCO INC., Tokyo (JP)

(72) Inventors: Takuma Nakano, Tokyo (JP); Takeshi Akiyama, Tokyo (JP); Takashi Oda, Tokyo (JP); Masaaki Suzuki, Tokyo (JP); Kimitaka Uchii, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 303 days.

This patent is subject to a terminal disclaimer.

(21) Appl. No.: 16/232,511

(22) Filed: Dec. 26, 2018

(65) Prior Publication Data

US 2019/0124973 A1 May 2, 2019

Related U.S. Application Data

(63) Continuation of application No. PCT/JP2017/023780, filed on Jun. 28, 2017.

(30) Foreign Application Priority Data

Jul. 1, 2016 (JP) ..... JP2016-131585
Jul. 1, 2016 (JP) ..... JP2016-131586
Jul. 1, 2016 (JP) ..... JP2016-131587

(51) Int. Cl.
*A24F 42/60* (2020.01)
*A24B 15/16* (2020.01)
(Continued)

(52) U.S. Cl.
CPC ..... *A24D 1/22* (2020.01); *A24B 15/165* (2013.01); *A24B 15/167* (2016.11); *A24D 1/002* (2013.01);
(Continued)

(58) Field of Classification Search
CPC ..... A24B 15/165; A24F 42/60
(Continued)

(56) References Cited

U.S. PATENT DOCUMENTS 2,907,686 A 10/1959 Siegel
4,765,347 A 8/1988 Sensabaugh, Jr. et al.
(Continued)

FOREIGN PATENT DOCUMENTS

CN 87103178 A 11/1987
CN 88100383 A 8/1988
(Continued)

OTHER PUBLICATIONS

European Communication pursuant to Article 94(3) EPC for European Application No. 17 820 224.8, dated Nov. 6, 2020.
(Continued)

*Primary Examiner* — Kelly M Gambetta
*Assistant Examiner* — Russell E Sparks
(74) *Attorney, Agent, or Firm* — Birch, Stewart, Kolasch & Birch, LLP

(57) ABSTRACT

A flavor inhaler includes a tubular holder that extends from a mouthpiece end toward a distal end, a flavor source that is provided in the holder, and a combustion type heat source that is provided at the distal end, and includes a protruding portion protruding from the distal end and a flavorant carried on the protruding portion.

18 Claims, 6 Drawing Sheets

(51) Int. Cl.

| | |
|---|---|
| ***A24D 1/22*** | (2020.01) |
| ***A24D 3/06*** | (2006.01) |
| ***A24D 3/17*** | (2020.01) |
| ***A24D 1/00*** | (2020.01) |
| ***A24B 15/167*** | (2020.01) |
| ***A24F 7/04*** | (2006.01) |

(52) U.S. Cl.
CPC ..... *A24D 3/06* (2013.01); *A24D 3/061* (2013.01); *A24D 3/17* (2020.01); *A24F 7/04* (2013.01); *A24F 42/60* (2020.01)

(58) Field of Classification Search
USPC ..... 131/187
See application file for complete search history.

(56) References Cited

U.S. PATENT DOCUMENTS

| | | | | |
|---|---|---|---|---|
| 4,793,367 | A | 12/1988 | Brackmann | |
| 4,819,665 | A | 4/1989 | Roberts et al. | |
| 4,966,171 | A | 10/1990 | Serrano et al. | |
| 4,989,619 | A | 2/1991 | Clearman et al. | |
| 5,065,776 | A | 11/1991 | Lawson et al. | |
| 5,067,499 | A | 11/1991 | Banerjee et al. | |
| 5,082,008 | A * | 1/1992 | Johnson | A24D 1/002 131/194 |
| 5,247,947 | A | 9/1993 | Clearman et al. | |
| 7,479,098 | B2 | 1/2009 | Thomas et al. | |
| 7,793,665 | B2 | 9/2010 | Dube et al. | |
| 8,186,359 | B2 | 5/2012 | Ademe et al. | |
| 8,739,802 | B2 | 6/2014 | Fagg | |
| 9,877,506 | B2 * | 1/2018 | Akiyama | A24D 1/027 |
| 2003/0159703 | A1 | 8/2003 | Yang et al. | |
| 2004/0261807 | A1 | 12/2004 | Dube et al. | |
| 2008/0029106 | A1 | 2/2008 | Mishra et al. | |
| 2008/0245377 | A1 | 10/2008 | Marshall et al. | |
| 2009/0007925 | A1 | 1/2009 | Rasouli et al. | |
| 2009/0065011 | A1 | 3/2009 | Maeder et al. | |
| 2011/0036367 | A1 | 2/2011 | Saito et al. | |
| 2011/0041861 | A1 | 2/2011 | Sebastian et al. | |
| 2011/0083676 | A1 | 4/2011 | Karles et al. | |
| 2013/0255702 | A1 * | 10/2013 | Griffith, Jr. | A24F 40/70 131/328 |
| 2014/0123991 | A1 * | 5/2014 | Fujita | B01J 20/28004 131/335 |
| 2015/0013703 | A1 | 1/2015 | Akiyama et al. | |
| 2015/0083150 | A1 | 3/2015 | Conner et al. | |
| 2017/0055578 | A1 | 3/2017 | Oda et al. | |

FOREIGN PATENT DOCUMENTS

| | | | | |
|---|---|---|---|---|
| CN | 1059265 | A | 3/1992 | |
| CN | 1059841 | A | 4/1992 | |
| CN | 101778578 | A | 7/2010 | |
| CN | 102481021 | A | 5/2012 | |
| CN | 104160007 | A | 11/2014 | |
| CN | 102481021 | B | 12/2014 | |
| CN | 104203017 | A | 12/2014 | |
| CN | 105705048 | A | 6/2016 | |
| EP | 0271036 | A2 | 6/1988 | |
| EP | 0277519 | A2 | 8/1988 | |
| EP | 0 352 109 | A2 | 1/1990 | |
| EP | 0 472 367 | A1 | 2/1992 | |
| JP | 63-164875 | A | 7/1988 | |
| JP | 63-192372 | A | 8/1988 | |
| JP | 2010-535530 | A | 11/2010 | |
| JP | 2013-502232 | A | 1/2013 | |
| TW | 201402027 | A | 1/2014 | |
| TW | 201545673 | A | 12/2015 | |
| TW | 201616988 | A | 5/2016 | |
| WO | WO 2009/022232 | A2 | 2/2009 | |
| WO | WO 2010/113702 | A1 | 10/2010 | |
| WO | WO 2013/146951 | A2 | 10/2013 | |
| WO | WO 2013/183761 | A1 | 12/2013 | |
| WO | WO-2014140168 | A2 * | 9/2014 | A24B 15/16 |
| WO | WO 2015/165709 | A1 | 11/2015 | |
| WO | WO 2015/174442 | A1 | 11/2015 | |

OTHER PUBLICATIONS

Taiwanese Office Action and Search Report for Taiwanese Application No. 106121981, dated Jan. 30, 2019 with English translation.
International Preliminary Report on Patentability and English translation of the Written Opinion of the International Searching Authority (Forms PCT/IB/373 and PCT/ISA/237) for International Application No. PCT/JP2017/023778, dated Jan. 10, 2019.
International Preliminary Report on Patentability and English translation of the Written Opinion of the International Searching Authority (Forms PCT/IB/373 and PCT/ISA/237) for International Application No. PCT/JP2017/023780, dated Jan. 10, 2019.
International Preliminary Report on Patentability and English translation of the Written Opinion of the International Searching Authority (Forms PCT/IB/373 and PCT/ISA/237) for International Application No. PCT/JP2017/023782, dated Jan. 10, 2019.
International Search Report, issued in PCT/JP2017/023780, dated Aug. 8, 2017.
Written Opinion of the International Searching Authority, issued in PCT/JP2017/023780, dated Aug. 8, 2017.
International Search Report and Written Opinion of the International Searching Authority (forms PCT/ISA/210 and PCT/ISA/237), dated Aug. 8, 2017, for International Application No. PCT/JP2017/023778 with an English translation of the International Search Report.
International Search Report and Written Opinion of the International Searching Authority (forms PCT/ISA/210 and PCT/ISA/237), dated Aug. 8, 2017, for International Application No. PCT/JP2017/023782 with an English translation of the International Search Report.
Extended European Search Report, dated Feb. 12, 2020, for European Application No. 17820224.8.
Extended European Search Report, dated Feb. 13, 2020, for European Application No. 17820226.3.
Taiwanese Office Action and Search Report for Taiwanese Application No. 106121982, dated Jun. 28, 2019, with English translation.
Chinese Office Action and Search Report for Chinese Application No. 201780040093.2, dated Sep. 16, 2020, with an English translation.
Chinese Office Action and Search Report for Chinese Application No. 201780040094.7, dated Sep. 16, 2020, with an English translation.
Chinese Office Action and Search Report for Chinese Application No. 201780040210.5, dated Sep. 17, 2020, with an English translation.
Eurasian Office Action dated Sep. 4, 2019 , for corresponding Eurasian Application No. 201990192, with English translation.
Extended European Search Report, dated Dec. 17, 2019, for European Application No. 17820225.5.
Taiwanese Office Action and Search Report for Taiwanese Application No. 106121981, dated Jun. 25, 2019, with a partial English translation.
U.S. Office Action for U.S. Appl. No. 16/233,019, dated Feb. 9, 2021.
U.S. Office Action for U.S. Appl. No. 16/232,527, dated Dec. 29, 2021.
U.S. Office Action for U.S. Appl. No. 16/233,019, dated Feb. 11, 2022.
U.S. Office Action for U.S. Appl. No. 16/233,019, dated Jun. 7, 2022.
U.S. Office Action for U.S. Appl. No. 16/233,019, dated Oct. 26, 2022.

* cited by examiner

FLAVOR INHALER AND METHOD OF MANUFACTURING COMBUSTION TYPE HEAT SOURCE

CROSS-REFERENCE TO RELATED APPLICATIONS

This application is a Continuation Application of PCT Application No. PCT/JP2017/023780, filed Jun. 28, 2017 and based upon and claiming the benefit of priority from prior Japanese Patent Applications No. 2016-131585 filed Jul. 1, 2016; No. 2016-131586 filed Jul. 1, 2016; and No. 2016-131587, filed Jul. 1, 2016 the entire contents of all of which are incorporated herein by reference.

FIELD

The present invention relates to a flavor inhaler capable of inhaling flavor from a mouthpiece end, and a method of manufacturing a combustion type heat source used for the flavor inhaler.

BACKGROUND

Jpn. Pat. Appln. KOKAI Publication No. 63-164875 discloses the smoking product containing the improved fuel elements. In the preferred embodiment of this document, the carbonaceous fuel elements contain, in essence, no volatile organic material.

Jpn. PCT National Publication No. 2010-535530 discloses a distillation-based smoking article. This document discloses that one or more flavorant agents may be applied to the rear end surface of the combustible heat source.

SUMMARY

Technical Problem

An object of the present invention is to provide a flavor inhaler that meets the users' needs.

Solution to Problem

A flavor inhaler according to one aspect of the present invention includes: a tubular holder that extends from a mouthpiece end toward a distal end; a flavor source that is provided in the holder; and a combustion type heat source that is provided at the distal end, and includes a protruding portion protruding from the distal end and a flavorant carried on the protruding portion.

Advantageous Effects of Invention

According to the present invention, it is possible to provide a flavor inhaler that meets the users' needs.

DETAILED DESCRIPTION

First Embodiment

Embodiments of the flavor inhaler will now be described with reference to the accompanying drawings. According to the disclosed flavor inhaler, for example, a user can taste a flavor from a flavor source by heating the flavor source by a combustion type heat source located on the distal side and inhaling it from the inhalation side.

Figure 1:
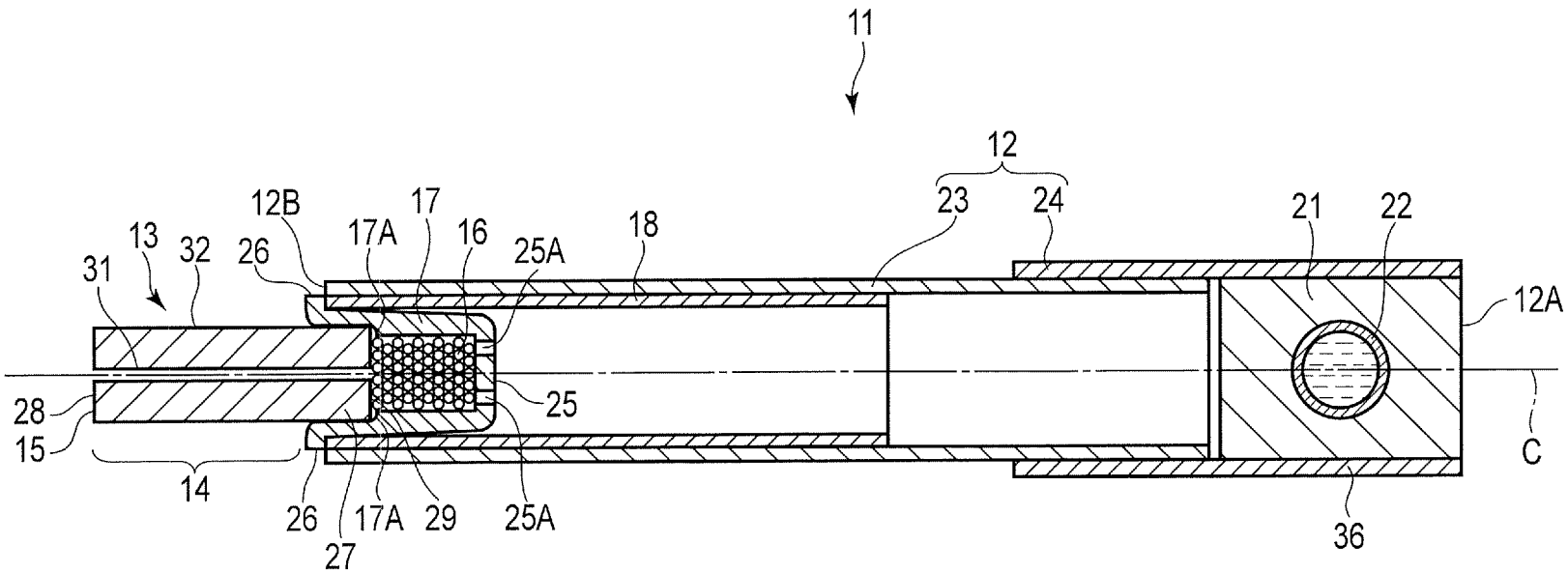
FIG. 1 is a cross-sectional view showing the flavor inhaler according to the first embodiment cut along a plane including a center axis C.

As shown in FIG. 1, the flavor inhaler 11 includes: a cylindrical holder 12 extending from a mouthpiece end 12A to a distal end 12B; a combustion type heat source 13 provided at the distal end 12B of the holder 12; a flavorant 15 carried on a protruding portion 14 of the combustion type heat source 13; a flavor source 16 provided in the holder 12; a cup 17 for accommodating the flavor source 16 therein; an aluminum laminate paper 18 interposed between the holder 12 and the cup 17 inside the holder 12; a filter portion 21 provided in the vicinity of the mouthpiece end 12A inside the holder 12; and a capsule 22 embedded inside the filter portion 21.

The holder 12 includes a first portion 23 that holds the combustion type heat source 13 and the cup 17, and a second portion 24 that connects the first portion 23 and the filter portion 21 located on the mouthpiece end 12A side. The first portion 23 is a paper pipe formed by winding paper in a cylindrical shape. The second portion 24 is paper used for tipping paper generally used as paper wrapped around a filter portion of a filter-attached cigarette (paper cigarette), and is formed by cylindrically winding the paper used for the tipping paper. The aluminum laminate paper 18 is formed by laminating aluminum on the paper, and as compared with ordinary paper, the heat resistance and the thermal conductivity are improved. The aluminum laminate paper 18 prevents the first portion 23 (paper pipe) of the holder 12 from burning even when the combustion type heat source 13 is ignited. The center axis C of the holder 12 coincides with the center axis C of the combustion type heat source 13.

The flavor source 16 is provided downstream of the combustion type heat source 13 at a position adjacent to the combustion type heat source 13. The flavor source 16 consists of granules formed from tobacco extracts and the like. Furthermore, the flavor source 16 is not limited to granules, and tobacco leaves themselves can be used. That is, as the flavor source 16, it is possible to adopt tobacco materials such as general cut tobacco used for cigarettes, granular tobacco used for snuff, roll tobacco, and molded tobacco. The flavor source 16 in which a flavor is carried on a carrier made of a porous material or a non-porous material may be adopted. The roll tobacco is obtained by molding sheet-like regenerated tobacco into a roll, and has a flow path inside. The molded tobacco is obtained by molding granular tobacco. The tobacco materials or the carriers used as the flavor source 16 may contain desired flavorants. The flavor source 16 has, for example, an acidic pH.

For analyzing the pH of the flavor source 16, for example, the following method can be adopted. First, 400 mg of the flavor source 16 is collected, 4 mL of pure water is added, and shaking extraction is carried out for 60 minutes. In a laboratory controlled at room temperature of 22° C., the extract is left in a sealed container until room temperature to harmonize the temperature. After harmonization, the lid is opened, and a glass electrode of a pH meter (SevenEasy S20 manufactured by METTLER TOLEDO) is soaked in a collection liquid to start the measurement. The pH meter is calibrated in advance using pH meter calibration liquids with pH 4.01, 6.87, and 9.21. A point at which output variations from a sensor become stable within 0.1 mV for 5 seconds is used as the pH of the extracted solution (flavor source 16). The pH measuring method of the flavor source 16 is an example, and other methods may of course be adopted.

The cup 17 is formed of a metallic material to have a bottomed cylindrical shape. The cup 17 includes a bottom portion 25 provided with a plurality of openings 25A. When the user performs inhalation, the tobacco flavor is inhaled to the downstream side of the holder 12 through the openings 25A together with the air. The cup 17 includes an edge portion 26 that is bent toward the radial outer side of the holder 12, and can be caught by the distal end of the holder 12 and the aluminum laminate paper 18. The inner peripheral surface of the cup 17 is provided with a step portion 17A that is in contact with the proximal end surface 29 of the combustion type heat source 13. The inner peripheral surface of the cup 17 can receive a main body portion 27 of the combustion type heat source 13 together with the step portion 17A to hold the combustion type heat source 13 to prevent it from falling off.

The cup 17 may be a cup made of paper. A cup made of paper has, for example, the same structure as that of the metal cup described above. A cup made of paper can be manufactured using known techniques of pulp injection molding. Specifically, a cup made of paper can be manufactured by kneading a raw material containing pulp, binder, and water, and injecting it into a heated mold, followed by drying and solidification. As the binder, it is preferable to use CMC (carboxymethyl cellulose) or CMC-Na (sodium carboxymethyl cellulose) from the viewpoint of flavor. A cup made of paper has the property that the heat conduction speed to the flavor source 16 is slower as compared to that of a metal cup. In addition, a cup made of paper can reduce the weight of the flavor inhaler and the manufacturing cost.

The filter portion 21 is composed of a filter generally used for cigarettes. Similarly, the capsule 22 is a flavor capsule generally used for cigarettes, and stores a liquid containing flavorants such as menthol.

The filter portion 21 can be formed of various types of fillers. In the present embodiment, the filter portion 21 is composed of a filler of cellulose semisynthetic fiber such as cellulose acetate, for example, but the filler is not limited thereto. Examples of the filler that can be used include plant fibers such as cotton, hemp, manila hemp, palm, rush, and the like, animal fibers such as wool and cashmere, cellulose-based regenerated fibers such as rayon, synthetic fibers such as nylon, polyester, acrylic, polyethylene, and polypropylene, or a combination thereof. Besides the above-mentioned filler of the cellulose acetate fiber, the constituent element of the filter portion 21 may be a charcoal filter containing charcoal or a filter containing particulates other than charcoal. Furthermore, the filter portion 21 may have a multi-segment structure in which two or more different types of segments are connected in the axial direction.

Figure 2:
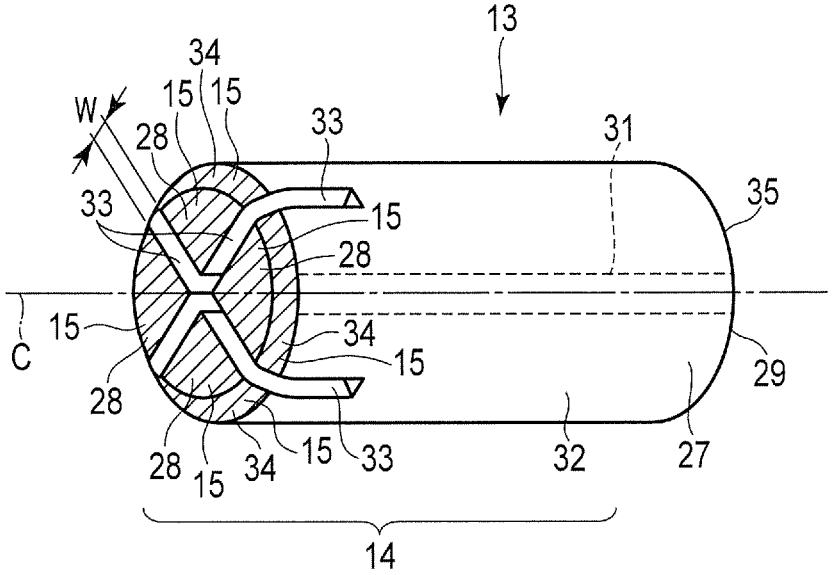
FIG. 2 is a perspective view showing the combustion type heat source of the flavor inhaler shown in FIG. 1.

As shown in FIG. 2, the combustion type heat source 13 (carbon heat source) is formed by integrally molding a combustion material that is a mixture containing activated carbon derived from plants, nonflammable additives, a binder (organic binder or inorganic binder), water, etc., by a method of tableting, press casting, or the like. The combustion type heat source 13 is a mixture of briquettes containing activated carbon, a binder, etc. The combustion type heat source 13 includes so-called highly activated carbon among activated carbon. Highly activated carbon indicates activated carbon having a specific surface area of, for example, 1300 $m^2/g$ or more, measured by the Brunauer. Emmet and Teller method (BET method) standardized by ISO9277:2010 as well as JISZ8830:2013. The activated carbon of the combustion type heat source 13 has a BET specific surface area of, for example, 1300 m2/g or more, and 2500 m2/g or less. The activated carbon used for the combustion type heat source 13 has a porous structure including a plurality of macropores and a plurality of micropores. Unlike the flavor source 16, the combustion type heat source 13 has, for example, a basic pH.

As an example, the combustion type heat source 13 can be manufactured by the following method. After mixing 235.5 g of highly activated carbon (BET specific surface area: 2050 m2/g), 323.8 g of calcium carbonate, and 28.1 g of sodium carboxymethyl cellulose, 745.3 g of water containing 5.4 g of sodium chloride is added, and further mixed. After the mixture is kneaded, extrusion molding is carried out to have a cylindrical shape having an outer diameter of 6.5 mm. The molded product obtained by the extrusion molding is dried and then cut to a length of 13 mm to obtain a primary molded product. A drill with a diameter of 1.0 mm is used to provide a through hole having an inner diameter of 1.0 mm at the center portion of the primary molded product. Cross groove processing is applied to one end surface of the primary molded product with a diamond cutting disc. Through these steps, the combustion type heat source 13 is completed.

The activated carbon used in the combustion type heat source 13 of the present embodiment is classified as high activated carbon, and has larger amounts of macropores and micropores than those of ordinary activated carbon. In other words, the activated carbon used in the combustion type heat source 13 of the present embodiment has a higher degree of activation than that of ordinary activated carbon. That is, the activated carbon used for the combustion type heat source 13 is obtained by applying heat treatment or the like to a carbon material to remove volatile impurities, to thereby increase the activation degree higher than that of ordinary activated carbon. The carbon material contained in the combustion type heat source 13 of the present embodiment is not limited to activated carbon classified as highly activated carbon, and may be, for example, a carbon material of another type such as general carbon or general activated carbon not classified as highly activated carbon.

The combustion type heat source 13 may contain activated carbon in the range of 10 wt % to 99 wt %. Here, from the viewpoint of supply of a sufficient amount of heat and combustion properties such as preventing ash from falling, it is preferable that the activated carbon contained in the combustion type heat source 13 has a concentration of, for example, 30 wt % or more and 60 wt % or less. More preferably, the activated carbon contained in the combustion type heat source 13 has a concentration of 30 wt % or more and 45 wt % or less.

As the organic binder, it is possible to use, for example, a mixture containing at least one of CMC (carboxymethyl cellulose), CMC-Na (carboxymethyl cellulose sodium), alginates, ethylene vinyl acetate (EVA), polyvinyl alcohol (PVA), polyvinyl acetate (PVAc), and sugars.

As the inorganic binder, it is possible to use, for example, a mineral-based binder such as purified bentonite, or a silica-based binder such as colloidal silica, water glass, and calcium silicate.

For example, from the viewpoint of flavor, the above-mentioned binder preferably contains 1 wt % to 10 wt % of CMC or CMC-Na, more preferably 1 wt % to 8 wt % of CMC or CMC-Na.

As the nonflammable additives, it is possible to use, for example, oxides or carbonates composed of sodium, potassium, calcium, magnesium, silicon, or the like. The combustion type heat source 13 can contain 40 wt % to 89 wt % of the nonflammable additive.

Here, it is preferable that calcium carbonate is used as the nonflammable additive, and that the combustion type heat source 13 contains 40 wt % to 60 wt % of the nonflammable additive.

For the purpose of improving combustion properties, the combustion type heat source 13 may contain alkali metal salt such as sodium chloride at a ratio of 1 wt % or less.

As shown in FIG. 1 and FIG. 2, the combustion type heat source 13 is formed to have a cylindrical shape. The combustion type heat source 13 includes: a main body portion 27 held in the holder 12; a protruding portion 14 (exposed portion) protruding from the distal end 12B of the holder 12; a distal end surface 28 provided in the protruding portion 14; a proximal end surface 29 facing the distal end surface 28; a ventilation path 31 for supplying air into the holder 12; an outer peripheral surface 32 adjacent to the distal end surface 28; and grooves 33 provided in the protruding portion 14. The ventilation path 31 is provided along the center axis C of the combustion type heat source 13, and is provided so as to penetrate the combustion type heat source 13. The ventilation path 31 communicates with the distal end surface 28 and the proximal end surface 29. The ventilation path 31 is provided so as to extend over both the main body portion 27 and the protruding portion 14. The portion on the distal end surface 28 side of the ventilation path 31 is integral with the grooves 33. The outer peripheral surface 32 is formed around the combustion type heat source 13 at a position corresponding to the protruding portion 14. The protruding portion 14 (exposed portion) also protrudes from the distal end of the cup 17.

The combustion type heat source 13 includes a first chamfered portion 34 formed between the distal end surface 28 and the outer peripheral surface 32, and a second chamfered portion 35 formed between the proximal end surface 29 and the outer peripheral surface 32. With the first chamfered portion 34 and the second chamfered portion 35, cracking or chipping in the comer portion of the combustion type heat source 13 is less likely to occur.

The grooves 33 are formed to have an overall cross shape as viewed from the distal end surface 28 side. The shape of the grooves 33 is not limited to a cross shape. The number of grooves 33 is discretionary. In addition, the shape formed by the entire grooves 33 can be discretionary. For example, a plurality of grooves 33 may extend radially toward the outer peripheral surface 32 about the ventilation path 31. In this case, the angle formed by the adjacent grooves 33 can be appropriately set within a range of, for example, 5° or more and 950 or less. Furthermore, in the present embodiment, the grooves 33 are formed to be recessed from the distal end surface 28 and the outer peripheral surface 32 so as to extend over them. The grooves 33 are provided so as to communicate with the ventilation path 31. The depth (length) of the grooves 33 with respect to the center axis C direction of the combustion type heat source 13 is, for example, preferably ⅓ to ⅕ of the total length with respect to the center axis C direction.

The combustion type heat source 13 is preferably formed to have the following dimensions. The total length of the combustion type heat source 13 (the length of the combustion type heat source 13 with respect to the center axis C direction) is appropriately set within a range of, for example, 5 mm or more and 30 mm or less, more preferably 10 mm or more and 20 mm or less. Among them, the length of the protruding portion 14 with respect to the center axis C direction is appropriately set within a range of, for example, 5 mm or more and 15 mm or less, more preferably 5 mm or more and 10 mm or less. Therefore, the length of the protruding portion 14 is set within a range of, for example, ⅔ or more and ⅘ or less of the total length of the combustion type heat source 13. The length of the portion of the combustion type heat source 13 inserted into the cup 17 (the length with respect to the center axis C direction of the main body portion 27, the insertion length) is appropriately set within a range of 2 mm or more and 10 mm or less, more preferably 2 mm or more and 5 mm or less.

The diameter of the combustion type heat source 13 (the length of the combustion type heat source 13 with respect to the direction intersecting with the center axis C) is appropriately set within a range of, for example, 3 mm or more and 15 mm or less. The depth (length) of the grooves 33 with respect to the center axis C direction is appropriately set within a range of, for example, 1 mm or more and 5 mm or less, more preferably 2 mm or more and 4 mm or less. The width (inner diameter) W of the grooves 33 is appropriately set within a range of, for example, 0.5 mm or more and 1 mm or less.

The grooves 33 may be provided to be recessed from at least one of the distal end surface 28 and the outer peripheral surface 32. For example, the grooves 33 may be provided so as to be recessed from the distal end surface 28 to communicate with the ventilation path 31, and may be provided so as not to be opened toward the outer peripheral surface 32 side. Likewise, for example, the grooves 33 may be provided so as to be recessed from the outer peripheral surface 32 to communicate with the ventilation path 31, and may be provided so as not to be opened toward the distal end surface 28 side. In the latter case, it is preferable that the ventilation path 31 extends to the distal end surface 28 and is opened to the outside on the distal end surface 28.

The combustion type heat source 13 may not have the ventilation path 31. In this case, it is preferable that the holder 12 (the first portion 23) is provided with a plurality of small holes for ventilation. When the user performs inhalation, air is supplied through the small holes to the holder 12 and the flavor source 16 in the holder 12.

In the present embodiment, the flavorant 15 is carried on the distal end surface 28 of the combustion type heat source 13 and the first chamfered portion 34. The flavorant 15 is composed of anethole, but may of course be flavorants other than anethole. As an alternative to anethol, the flavorant 15 may be, anisaldehyde, 2-pinene, 2-β-pinene, sabinene, limonene, 1,8-cineole, m-cymene, 4-terpineol, myristicin, β-citronellol, nerol, phenethyl alcohol, linalyl acetate, benzyl acetate, jasmone, decanal, linalool, or the like. Anethole and these flavorants alternative to anethole can have the residual rate of flavorant of 50% or more even after storage for 4 weeks, for example. Thus, using anethole and a flavorant alternative to anethole improves storage stability.

A flavorant as an alternative to anethole may be, more preferably, anisaldehyde, 2-pinene, 2-D-pinene, sabinene, limonene, 1,8-cineole, m-cymene, 4-terpineol, myristicin, β-citronellol, phenethyl alcohol, linalyl acetate, benzyl acetate, jasmone, linalool, or the like. Anethole and a flavorant alternative to anethole can have the residual rate of flavorant of 70% or more even after storage for 4 weeks, for example. Thus, using anethole and a flavorant alternative to anethole improves storage stability.

The flavorant 15 may be prepared by mixing a plurality of flavorants. It is desirable that the flavorant 15 is, in essence, not carried on the proximal end surface 29 and the second chamfered portion 35 of the combustion type heat source 13. However, it is likely that the flavorant 15 that is volatilized or diffused from the distal end surface 28 and the first chamfered portion 34 will be adsorbed and held on the proximal end surface 29 and the second chamfered portion 35.

The amount of flavorant 15 carried on the combustion type heat source 13 may be set to change along the center axis C. That is, in the present embodiment, the largest amount of flavorant 15 is carried on the distal end surface 28 and the first chamfered portion 34. In this case, the amount of flavorant 15 to be carried may not be uniform inside the combustion type heat source 13. The flavorant 15 may be carried inside the combustion type heat source 13 so that the amount of flavorant 15 gradually decreases from the distal end surface 28 toward the proximal end surface 29.

Figure 3:
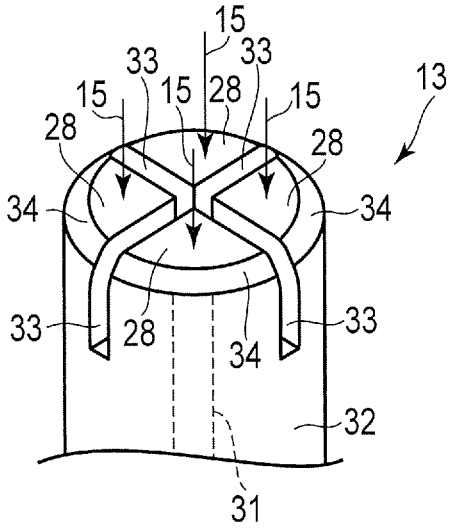
FIG. 3 is a perspective view showing the process of manufacturing the combustion type heat source of the flavor inhaler shown in FIG. 1.

Various methods can be adopted as a method of carrying the flavorant 15 on the distal end surface 28 and the first chamfered portion 34 of the combustion type heat source 13. For example, as shown in FIG. 3, a nozzle is disposed to face the distal end surface 28, and droplets of the liquid containing the flavorant 15 are discharged (dropped) from the nozzle toward the distal end surface 28 and the first chamfered portion 34 as indicated by the arrows in FIG. 3, causing the liquid containing the flavorant 15 to adhere to the distal end surface 28 and the first chamfered portion 34. The liquid containing the flavorant 15 may be discharged to the entire distal end surface 28, or may be partially discharged to a part of the distal end surface 28. For example, in order to prevent the flavorant 15 from adhering to the portion corresponding to the ventilation path 31 (the ventilation path 31 and the wall portion defining the outer edge of the ventilation path 31), it is desirable to discharge droplets of the liquid containing the flavorant 15 to a position deviated from the portion corresponding to the ventilation path 31. As this liquid permeates into the combustion type heat source 13 from the distal end surface 28, the flavorant 15 is carried in the vicinity of the distal end surface 28. Alternatively, the flavorant 15 can also be carried in the vicinity of the distal end surface 28, and the first chamfered portion 31, by grasping the position on the proximal end surface 29 side of the outer peripheral surface 32 of the combustion type heat source 13, and then immersing the distal end surface 28 of the combustion type heat source 13 into the liquid containing the flavorant 15 for a predetermined period of time. In addition, by pressing the distal end surface 28 against an elastic porous body (e.g., a sponge) containing the flavorant 15, the flavorant 15 can be carried in the vicinity of the distal end surface 28 and the first chamfered portion 31. Furthermore, an ink-jet type can be used for discharging droplets of liquid containing the flavorant 15.

Moreover, the flavorant 15 may be carried on the combustion type heat source 13 after the combustion type heat source 13 is inserted into the cup 17. In this case, as a method of discharging droplets, it is preferable to adopt, for example, a method of discharging, in an accurate manner, a liquid containing the flavorant 15 toward only the combustion type heat source 13 (e.g., an ink-jet type), a method of immersing only the combustion type heat source 13 in the liquid containing the flavorant 15, or a method in which, if an elastic porous body containing the flavorant 15 is used, only the combustion type heat source 13 is brought into contact with the porous body while the cup 17 part is prevented from being brought into contact with the porous body. This can prevent the flavorant 15 from being unintentionally added to the cup 17, or to the flavor source in the cup 17.

The effects of the flavor inhaler 11 according to the present embodiment will be described. When the user takes out the flavor inhaler 11 from the package prior to inhalation of the flavor inhaler 11, the user can sense the flavor (external flavor) diffused from the distal end surface 28 of the combustion type heat source 13. Moreover, when or after the user lights the combustion type heat source 13 with the mouthpiece 36 of the holder 12 being put between the lips, the user can sense the flavor (external flavor) diffused from the distal end surface 28 by the heat from the ignition source or the combustion type heat source 13.

When the user lights somewhere in vicinity of the distal end surface 28 of the combustion type heat source 13 and starts inhalation, the combustion type heat source 13 generates heat to a predetermined temperature (for example, 250° C. to 900° C.), and the flavor source 16 is heated by the heat from the combustion type heat source 13. As a result, the components contained in the flavor source 16 are diffused, and reach the user's mouth through the filter portion 21. In this manner, the user can enjoy the smoking flavor from the flavor source 16. At this time, the flavorant carried on the distal end surface 28 is taken inside the holder 12 together with the surrounding air through the ventilation path 31, mixed with the components released from the flavor source 16 in the cup 17, and reaches the user's mouth through the filter portion 21. Therefore, the user can also sense the flavorant 15 carried on the distal end surface 28 as an internal flavor contained in the mainstream smoke. Furthermore, the user can also change the smoking flavor of the mainstream smoke by crushing the capsule 22 with a finger as necessary.

When the user performs inhalation for a predetermined time and the combustion type heat source 13 burns out, or when the smoking flavor from the flavor source 16 is gone, the inhalation is completed. At this time, the ash of the combustion type heat source 13 is held at the distal end of the holder 12 without falling on the ground, and thus there is little impact on the surrounding environment. Moreover, the smoke generated from the flavor inhaler 11 is significantly less as compared to conventional paper-wrapped tobaccos (cigarettes), and thus the impact on the surrounding environment is small.

The flavor inhaler according to the present invention includes: a tubular holder 12 that extends from a mouthpiece end 12A toward a distal end 12B, a flavor source 16 that is provided in the holder 12, and a combustion type heat source 13 that is provided at the distal end 12B, and includes a protruding portion 14 protruding from the distal end 12B and a flavorant 15 carried on the protruding portion 14. According to this structure, the flavorant is carried on a position exposed outside the combustion type heat source 13, and thus the flavorant 15 can be contributed not only as an internal flavor that is taken into the mainstream smoke and can be sensed through the user's mouth, but also as an external flavor in which the flavor diffused from the projecting portion 14 is directly delivered to the user's nose. In particular, the protruding portion 14 of the combustion type heat source 13 is positioned close to the user's nose when the flavor inhaler 11 is put between the lips, and thus even a small amount of flavorant 15 can be efficiently delivered to the user's nose (external flavor). Thus, it is possible to realize the flavor inhaler 11 matching the user's preference. The internal flavor used herein refers to a flavor sensed by flavorant components delivered to the nose (nasal cavity) after passing through the mouth (oral cavity). The external flavor refers to a flavor sensed by flavorant components delivered to the nose (nasal cavity) without passing through the mouth (oral cavity).

The protruding portion 14 includes the distal end surface 28, and the flavorant 15 is carried on the distal end surface 28. According to this structure, it is possible to carry the flavorant 15 on the distal end surface 28 which is less likely to be held by the user, and to prevent a problem that the flavorant 15 is transferred to the user's fingers or the like even if the user holds the outer peripheral surface 32 of the combustion type heat source 13 before inhaling the flavor inhaler 11.

In the present embodiment, it is preferable that the combustion type heat source 13 contains highly activated carbon. Highly activated carbon can stably retain the flavorant 15 in its micropores for a long period of time. According to the above-described structure, because of high particle-adsorption ability of highly activated carbon, it is possible to maintain a large total amount of flavorant 15 remaining in the flavor inhaler 11 after storage. Moreover, ignition properties can be improved by the porous structure of highly activated carbon, and the flavor inhaler 11 that can be easily ignited can be realized. In addition, with the porous structure of highly activated carbon, combustion properties of the combustion type heat source 13 can be improved, and stable combustion can be continued in the combustion type heat source 13.

In the following, with reference to FIG. 4 to FIG. 10, the second to eighth embodiments will be described in which the partial modifications have been made to the first embodiment. In the embodiments below, mainly the parts different from those of the first embodiment will be described, and explanations of the parts identical to those of the first embodiment will be omitted.

Second Embodiment

Figure 4:
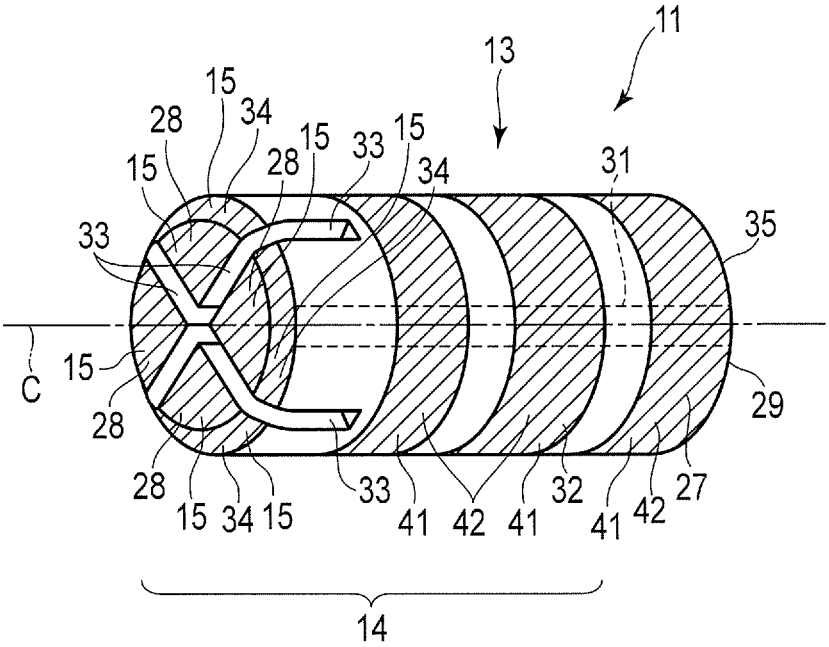
FIG. 4 is a perspective view showing the combustion type heat source of the flavor inhaler according to the second and third embodiments.

FIG. 4 shows the combustion type heat source 13 of the flavor inhaler 11 according to the second embodiment. The combustion type heat source 13 has the same shape as that in the first embodiment. In the present embodiment, the combustion type heat source 13 includes the flavorant 15 carried on the distal end surface 28 and the first chamfered portion 34 of the combustion type heat source 13, and the second flavorant 41 carried on the outer peripheral surface 32 of the combustion type heat source 13. The second flavorant 41 is carried on a plurality of annular carriers 42 formed on the outer peripheral surface 32 at a predetermined interval in the center axis C direction. The plurality of carriers 42 are formed in a belt shape having a predetermined width in the center axis C direction. The carriers 42 are not limited to a plurality of carriers having an annular shape. The carriers 42 may be formed in a single wide belt shape (annular shape). Furthermore, the shape of the carriers 42 is not limited to the annular shape; for example, a plurality of belt-like carriers 42 linearly extending parallel to the center axis C may be provided. In this case, it is preferable that the carriers 42 are disposed with a certain interval from adjacent other carriers 42. At this time, the plurality of carriers 42 are disposed with a certain interval around the center axis C.

In the present embodiment, the second flavorant 41 only differs from the flavorant 15 in the carrying position on the combustion type heat source 13, and has the same components as those of the flavorant 15. That is, the flavorant 15 and the second flavorant 41 are composed of, for example, anethole. The flavorant 15 and the second flavorant 41 may of course be the flavorants described in the first embodiment. The flavorant 15 and the second flavorant 41 may be prepared by mixing a plurality of flavorants.

The amount of second flavorant 41 carried on the combustion type heat source 13 may be set to change along the radial direction of the combustion type heat source 13. That is, in the present embodiment, the largest amount of second flavorant 41 is carried on the outer peripheral surface 32. In this case, the amount of second flavorant 41 to be carried may not be uniform inside the combustion type heat source 13. The second flavorant 41 may be carried inside the combustion type heat source 13 so that the amount of flavorant 15 gradually decreases from the outer peripheral surface 32 toward the center axis C.

The method of carrying the flavorant 15 on the distal end surface 28 and the first chamfered portion 34 of the combustion type heat source 13 is the same as that in the first embodiment.

Various methods can be adopted as a method of carrying the second flavorant 41 on the outer peripheral surface 32 of the combustion type heat source 13. For example, a plurality of minimal rollers partially immersed in a liquid containing the second flavorant 41 are prepared, in which the rollers are placed in series with each other. Each roller rotates in a direction intersecting with a direction in which a plurality of rollers are placed in series. The combustion type heat source 13 is disposed so as to extend over, from the upper side, the plurality of rollers configured in the above-described manner, and the combustion type heat source 13 is rotated on the plurality of rollers. Thereby, the second flavorant 41 can be transferred (applied) so as to form a plurality of belt-shaped (annular) carriers 42 on the outer peripheral surface 32. Alternatively, the second flavorant 41 can be carried on the outer peripheral surface 32 by continuously applying a liquid containing the second flavorant 41 having a relatively high viscosity from a nozzle adjacent to the outer peripheral surface 32 to the rotated combustion type heat source 13. In addition, various methods such as an ink-jet type can be used for a method of applying the second flavorant 41 to the outer peripheral surface 32 to carry the second flavorant 41 on the outer peripheral surface 32.

The effects of the flavor inhaler 11 according to the present embodiment will be described. When the user takes out the flavor inhaler 11 from the package prior to inhalation of the flavor inhaler 11, in a manner similar to that in the first embodiment, the user can sense the flavor (external flavor) diffused from the flavorant 15 on the distal end surface 28 of the combustion type heat source 13, and the second flavorant 41 on the outer peripheral surface 32. Moreover, before or after the user lights the combustion type heat source 13 with the mouthpiece 36 of the holder 12 being put between the lips, the user can sense the flavor (external flavor) diffused from the flavorant 15 on the distal end surface 28, and the second flavorant 41 on the outer peripheral surface 32.

When the user lights the combustion type heat source 13 and starts inhalation, the combustion type heat source 13 generates heat to a predetermined temperature (for example, 250° C. to 900° C.), and the flavor source 16 is heated by the heat from the combustion type heat source 13. As a result, the components contained in the flavor source 16 are diffused, and reach the user's mouth through the filter portion 21. In this manner, the user can enjoy the smoking flavor from the flavor source 16. At this time, the flavorant 15 carried on the distal end surface 28 is taken inside the holder 12 together with the surrounding air through the ventilation path 31, mixed with the components released from the flavor source 16 in the cup 17, and reaches the user's mouth through the filter portion 21. Therefore, the user can also sense the flavorant 15 carried on the distal end surface 28 as an internal flavor. Furthermore, the user can also change the smoking flavor of the mainstream smoke by crushing the capsule 22 with a finger as necessary.

When the user performs inhalation for a predetermined time and the combustion type heat source 13 burns out, or when the smoking flavor from the flavor source 16 is gone, usage of the flavor inhaler 11 is completed.

According to the second embodiment, the protruding portion 14 includes the outer peripheral surface 32 adjacent to the distal end surface 28, and the second flavorant 41 carried on the outer peripheral surface 32. According to this structure, in addition to the flavorant 15 carried on the distal end surface 28, the second flavorant 41 can also be carried on the outer peripheral surface 32, and thus it is possible to increase the total weights of flavorant 15 and second flavorant 41 carried on the combustion type heat source 13. Thus, it is possible to carry a sufficient amount of flavorant 15 and second flavorant 41 on the combustion type heat source 13. Therefore, it is possible to reliably deliver, to the user, the internal flavor taken into the mainstream smoke, and the external flavor not passing through inside the holder 12. Thus, it is possible to realize the flavor inhaler 11 matching the user's preference.

The second flavorant 41 is same as the flavorant 15. According to this structure, it is possible to increase the area in which the flavorant 15 is carried, and to more efficiently deliver the flavor generated from the flavorant 15.

The outer peripheral surface 32 includes the annular carriers 42 that carry the second flavorant 41. According to this structure, it is possible to easily change the amount of second flavorant 41, by changing the width of annular carriers 42 (the length with respect to the center axis C direction of the combustion type heat source 13), or changing the number of annular carriers 42. In the present embodiment, the plurality of annular carriers 42 on the outer peripheral surface 32 all carry the same second flavorant 41, but they may carry flavorants different between the annular carriers 42 adjacent to each other.

Third Embodiment

In the third embodiment, the combustion type heat source 13 of the flavor inhaler 11 has the same appearance as that of the combustion type heat source 13 of the flavor inhaler 11 according to the second embodiment shown in FIG. 4. Thus, in the present embodiment, a description will be given below based on FIG. 4.

The combustion type heat source 13 in the third embodiment has the same shape as that in the second embodiment. In the present embodiment, the combustion type heat source 13 includes the flavorant 15 carried on the distal end surface 28 and the first chamfered portion 34 of the combustion type heat source 13, and the second flavorant 41 carried on the outer peripheral surface 32 of the combustion type heat source 13. In the third embodiment, unlike the second embodiment, the second flavorant 41 is different from the flavorant 15. That is, the flavorant 15 is composed of, for example, anethole. The second flavorant 41 is composed of, for example, limonene. The flavorant 15 may be flavorants other than anethole, and may be the flavorants described in the first embodiment. The second flavorant 41 may be flavorants other than limonene, and may be the flavorants described in the first embodiment. The flavorant 15 and the second flavorant 41 may be prepared by mixing a plurality of flavorants. The concept of "different" used herein does not mean that only types of compounds are different. The concept of "different" includes, if a flavorant is prepared by mixing a plurality of compounds, (1) a case where types (combinations) of compounds as constituent elements of the flavorant are different, and (2) a case where types (combinations) of compounds as constituent elements of the flavorant are the same while a mixing ratio of compounds is different from each other.

The amount of second flavorant 41 carried on the combustion type heat source 13 may be set to change along the radial direction of the combustion type heat source 13. That is, in the present embodiment, the largest amount of second flavorant 41 is carried on the outer peripheral surface 32. In this case, the amount of second flavorant 41 to be carried may not be uniform inside the combustion type heat source 13. The second flavorant 41 may be carried inside the combustion type heat source 13 so that the amount of flavorant 15 gradually decreases from the outer peripheral surface 32 toward the center axis C.

The method of carrying the flavorant 15 and the second flavorant 41 on the combustion type heat source 13 is the same as that in the second embodiment. The function of the flavor inhaler 11 of the present embodiment is substantially the same as that in the second embodiment.

According to the present embodiment, the second flavorant 41 is different from the flavorant 15. According to this structure, it is possible to change types between the flavorant 15 carried on the distal end surface 28 of the combustion type heat source 13, and the second flavorant 41 carried on the outer peripheral surface 32. Thus, according to the combustion type heat source 13 of the present embodiment, it is possible to realize a flavor generated by mixing multiple types of flavorants, thereby increasing alternatives of the flavor combinations in designing the product.

Fourth Embodiment

Figure 5:
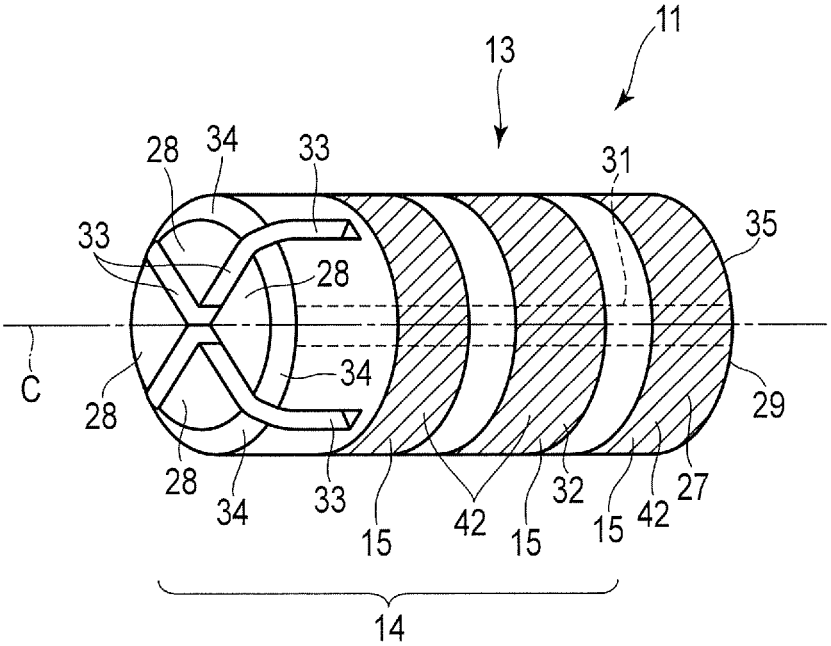
FIG. 5 is a perspective view showing the combustion type heat source of the flavor inhaler according to the fourth embodiment.

FIG. 5 shows the combustion type heat source 13 of the flavor inhaler 11 according to the fourth embodiment. The combustion type heat source 13 has the same shape as that in the first embodiment. In the present embodiment, the combustion type heat source 13 includes the flavorant 15 carried on the outer peripheral surface 32 of the combustion type heat source 13. Moreover, no flavorant is carried on the distal end surface 28 of the combustion type heat source 13. The flavorant 15 is carried on a plurality of annular carriers 42 formed on the outer peripheral surface 32 at a predetermined interval in the center axis C direction. The plurality of carriers 42 are formed in a belt shape having a predetermined width in the center axis C direction.

It is preferable that the plurality of carriers 42 are provided closer to the proximal end surface 29 side (the mouthpiece end 12A side) than to the distal end surface 28 and the grooves 33. Furthermore, it is preferable that the plurality of carriers 42 are provided on the proximal end surface 29 side (the mouthpiece end 12A side) by 3 mm or more from the distal end surface 28. More preferably, the plurality of carriers 42 are desirably provided on the proximal end surface 29 side (the mouthpiece end 12A side) 5 mm or more from the distal end surface 28. By the arrangement of the carriers 42, the flavorant 15 can be disposed at a position which is not exposed to fire even when the user lights somewhere in vicinity of the distal end surface 28. Such an arrangement is particularly effective when the flavorant 15 that is likely to lose its flavor by ignition is carried on the carriers 42. The carriers 42 are not limited to a plurality of annular shapes. The carriers 42 may be formed in a single wide belt shape (annular shape).

The flavorant 15 is composed of anethole, but may of course be flavorants other than anethole. The flavorant 15 may be flavorants other than anethole, and may be the flavorants described in the first embodiment. The flavorant 15 may be prepared by mixing a plurality of flavorants.

The amount of flavorant 15 carried on the combustion type heat source 13 may be set to change along the radial direction of the combustion type heat source 13. That is, in the present embodiment, the largest amount of flavorant 15 is carried on the outer peripheral surface 32. In this case, the amount of flavorant 15 to be carried may not be uniform inside the combustion type heat source 13. The flavorant 15 may be carried inside the combustion type heat source 13 so that the amount of flavorant 15 gradually decreases from the outer peripheral surface 32 toward the center axis C.

In the present embodiment, the method of applying the flavorant 15 is the same as the method of applying the second flavorant 41 carried on the outer peripheral surface 32 of the combustion type heat source 13 of the second embodiment.

According to the present embodiment, the protruding portion 14 includes the outer peripheral surface 32, and the flavorant 15 is carried on the outer peripheral surface 32. According to this structure, in the case where it is desired to not arrange the flavorant 15 on the distal end surface 28 that will be the ignition surface when the combustion type heat source 13 is ignited, it is possible to arrange the flavorant 15 on only the outer peripheral surface 32. The arrangement of the flavorant 15 like the present embodiment is effective when, for example, it is desired to carry the flavorant 15 that is likely to lose its flavor by ignition on the combustion type heat source 13. Thus, it is possible to further increase alternatives of flavorants, and to further improve the degree of freedom in designing the product.

Fifth Embodiment

Figure 6:
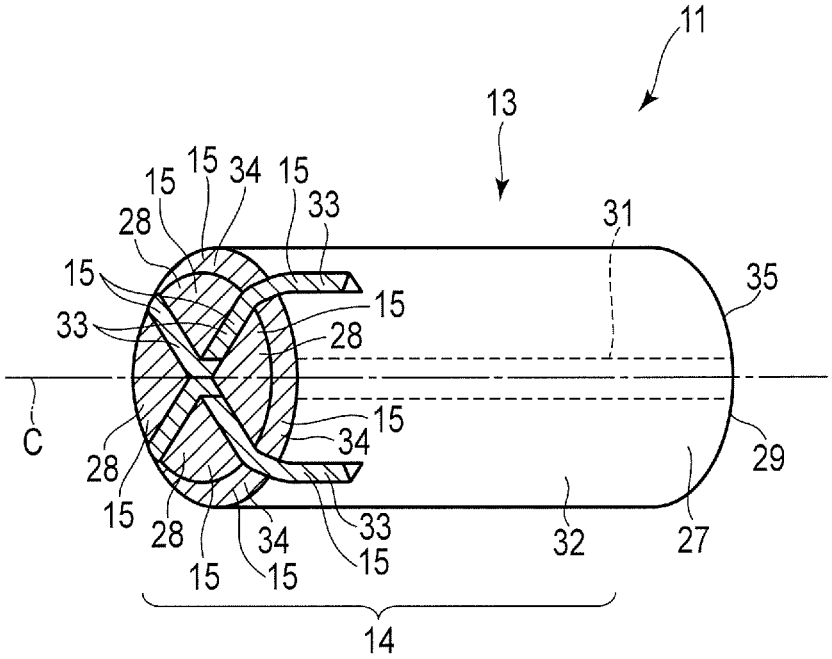
FIG. 6 is a perspective view showing the combustion type heat source of the flavor inhaler according to the fifth embodiment.
Figure 7:
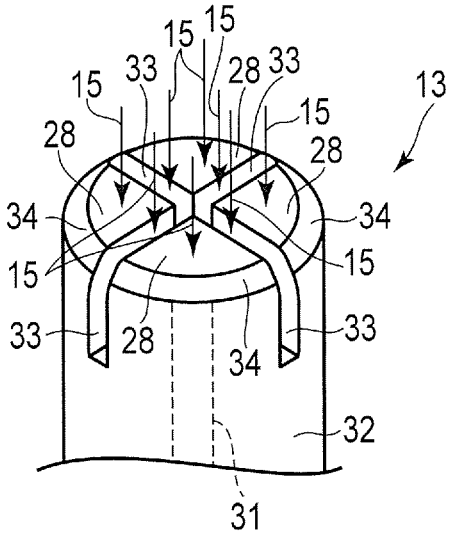
FIG. 7 is a perspective view showing the process of manufacturing the combustion type heat source of the flavor inhaler shown in FIG. 6.

FIG. 6 and FIG. 7 show the combustion type heat source 13 of the flavor inhaler 11 according to the fifth embodiment. The combustion type heat source 13 has the same shape as that in the first embodiment. In the present embodiment, the flavorant 15 is carried on the distal end surface 28, the first chamfered portion 34, and the inner peripheral surface of the grooves 33 of the combustion heat source 13.

The flavorant 15 is composed of anethole, but may of course be flavorants other than anethole. The flavorant 15 may be flavorants other than anethole, and may be the flavorants described in the first embodiment. The flavorant 15 may be prepared by mixing a plurality of flavorants.

Various methods can be adopted as a method of carrying the flavorant 15 on the distal end surface 28, the first chamfered portion 34, and the grooves 33 of the combustion type heat source 13. For example, as shown in FIG. 7, a nozzle may be disposed to face the distal end surface 28, and droplets of the liquid containing the flavorant 15 are discharged (dropped) from the nozzle, causing the liquid containing the flavorant to adhere to the distal end surface 28, to the first chamfered portion 34, and to the grooves 33. In this case, in order to prevent the flavorant 15 from adhering to the portion corresponding to the ventilation path 31 (the ventilation path 31 and the wall portion defining the outer edge of the ventilation path 31), it is desirable to discharge droplets of the liquid containing the flavorant 15 to a position deviated from the ventilation path 31. As this liquid permeates into the combustion type heat source 13 from the distal end surface 28 and the inner peripheral surface of the grooves 33, the flavorant 15 is carried in the vicinity of the distal end surface 28 and in the vicinity of the grooves 33. Alternatively, the flavorant 15 can be carried in the vicinity of the distal end surface 28 and the first chamfered portion 34, and in the vicinity of the grooves 33, by grasping the position on the proximal end surface 29 side of the outer peripheral surface 32 of the combustion type heat source 13, and then immersing the portion on the distal end surface 28 of the combustion type heat source 13 into the liquid containing the flavorant 15 until the distal end surface 28 and grooves 33 are entirely soaked for a predetermined period of time.

According to the present embodiment, the projecting portion 14 includes the distal end surface 28, and the outer peripheral surface 32 adjacent to the distal end surface 28; the combustion type heat source 13 includes the ventilation path 31 for supplying air into the holder 12, and grooves 33 that are provided in the projecting portion 14 to be recessed from at least one of the distal end surface 28 and the outer peripheral surface 32, and that communicates with the ventilation path 31; and the flavorant 15 is carried on the grooves 33.

If the grooves 33 are formed to communicate with the ventilation path 31, the airflow provided when the user performs inhalation from the mouthpiece end 12A includes the flow in a direction along the extending direction of ventilation path 31, the flow running to the ventilation path 31 along the distal end surface 28, and the flow passing through the grooves 33 and running to the ventilation path 31.

According to the above-described structure, the grooves 33 that communicate with the ventilation path 31 are provided, and the flavorant 15 is carried on the grooves 33; thus, in comparison to when the flavorant 15 is carried on only the distal end surface 28, it is possible to increase the area (surface area) in which the air running to the ventilation path 31 is brought into contact with the flavorant 15 carried on the combustion type heat source 13. Thus, it is possible to contain the flavor, in a more effective manner, in the mainstream smoke as an internal flavor. Therefore, it is possible to realize the flavor inhaler 11 that is capable of delivering the sufficient flavor into the user's oral cavity by the small total amount of flavorant 15, and that is cost-effective in terms of flavorant delivery. Moreover, because of an increase in the delivery efficiency as described above, it is possible to reduce the total weight of flavorant 15 to be used, which makes it possible to reduce the cost of manufacturing the flavor inhaler 11.

The flavorant 15 is carried on the distal end surface 28. According to this structure, in addition to the flavorant 15 in the grooves 33, it is possible to additionally contain the flavorant 15. Thus, for example, the flavorant 15 carried inside the grooves 33 can be used mainly as an internal flavor contained in the mainstream smoke, and the flavorant 15 carried on the distal end surface 28 can be used mainly as an external flavor delivered directly to the user's nose. In such a manner, it is possible to also design a product in a precise manner in which a use for each region of the combustion type heat source 13 is changed, and to realize the flavor inhaler 11 providing the smoking flavor having a sense of depth.

The method of manufacturing the combustion type heat source 13 provided at the distal end of the tubular holder 12 according to the present embodiment forms the combustion material including the distal end surface 28 and the grooves 33 recessed from the distal end surface 28, and brings the liquid containing the flavorant 15 into contact with the combustion material to carry the flavorant 15 on the distal end surface 28 and the grooves 33.

According to this structure, by the simple method using liquid penetration, it is possible to carry the flavorant 15 on the combustion type heat source 13, and to manufacture, in an effective manner, the combustion type heat source 13 having flavorants.

According to the present embodiment, droplets of the liquid containing the flavorant 15 adhere, from the distal end surface 28 side, to the distal end surface 28 and to the grooves 33 of the combustion material. According to this structure, by the simple process of causing droplets to adhere to the combustion type heat source 13 and utilizing liquid penetration, it is possible to carry the flavorant on the combustion type heat source 13.

The combustion material has a porous structure. The porous structure is realized by, for example, micropores of highly activated carbon contained in the combustion type heat source 13. According to this structure, because of the high particle-adsorption ability of highly activated carbon, it is possible to maintain a large total amount of flavorant 15 remaining in the flavor inhaler 11 after storage. In addition, it is possible to carry the flavorant on the combustion type heat source 13 using the liquid penetration into the porous structure, and to manufacture the combustion type heat source by the sample and quick process.

The liquid containing the flavorant 15 adheres to the distal end surface 28 and the grooves 33 at a position deviated from the ventilation path 31 formed to penetrate the combustion material. According to this structure, it is possible to not carry the flavorant 15 on the ventilation path 31 by the simple method. Thus, for example, it is possible to purposely not arrange the flavorant 15 on the ventilation path 31, and to increase the degree of freedom in designing the product.

According to the method of manufacturing the combustion type heat source of one modification of the present embodiment, the distal end surface 28 and the grooves 33 of the combustion material are immersed into the liquid containing the flavorant 15. According to this structure, it is possible to carry a sufficient amount of flavorant 15 on the combustion type heat source 13 by the simple method.

Sixth Embodiment

Figure 8:
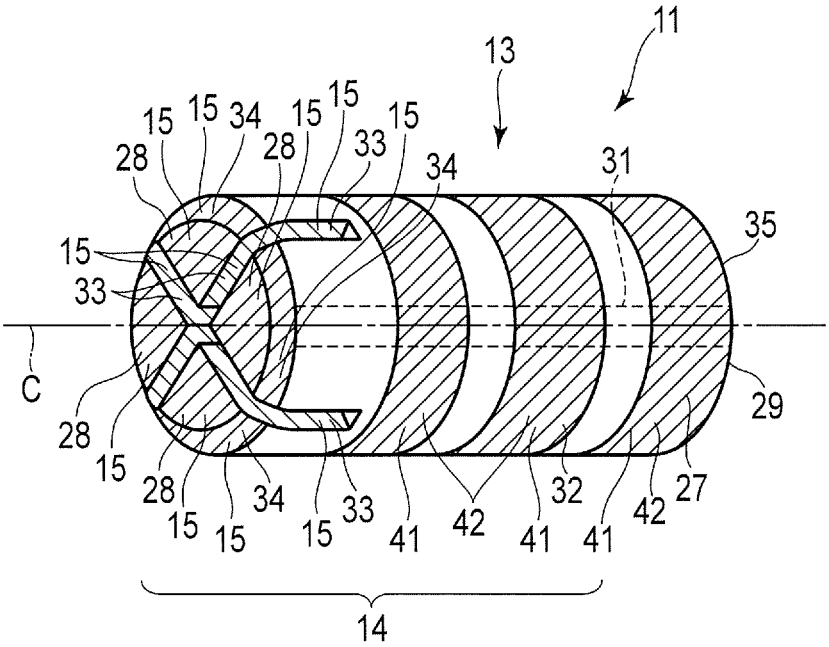
FIG. 8 is a perspective view showing the combustion type heat source of the flavor inhaler according to the sixth and seventh embodiments.

FIG. 8 shows the combustion type heat source 13 of the flavor inhaler 11 according to the sixth embodiment. The combustion type heat source 13 has the same shape as that in the first embodiment. In the present embodiment, the flavorant 15 is carried on the distal end surface 28, the first chamfered portion 34, and the inner peripheral surface of the grooves 33 of the combustion heat source 13. The second flavorant 41 is carried on the outer peripheral surface 32 of the combustion type heat source 13.

The second flavorant 41 is carried on a plurality of annular carriers 42 formed on the outer peripheral surface 32 at a predetermined interval in the center axis C direction. The plurality of carriers 42 are formed in a belt shape having a predetermined width in the center axis C direction. The carriers 42 are not limited to a plurality of carriers having an annular shape. The carriers 42 may be formed in a single wide belt shape (annular shape).

In the present embodiment, the second flavorant 41 is only different from the flavorant 15 in the carrying position on the combustion type heat source 13, and has the same components as those of the flavorant 15. That is, the flavorant 15 and the second flavorant 41 are composed of, for example, anethole. The flavorant 15 and the second flavorant 41 may of course be the flavorants described in the first embodiment except for anethole. The flavorant 15 and the second flavorant 41 may be prepared by mixing a plurality of flavorants.

The method of carrying the flavorant 15 on the distal end surface 28, the first chamfered portion 34, and the grooves 33 of the combustion type heat source 13 is the same as that in the fifth embodiment. The method of carrying the second flavorant 41 on the combustion type heat source 32 is the same as the method of carrying the second flavorant 41 on the combustion type heat source 32 in the second embodiment.

In the present embodiment, the flavorant 15 and the second flavorant 41 are the same flavorant, and thus an ink-jet type or the like may be used to collectively apply the flavorant 15 to the distal end surface 28, the first chamfered portion 34, the grooves 33, and the outer peripheral surface 32 to thereby carry the flavorant 15 on the combustion type heat source 13. Other than the above, various methods can be adopted as a method of carrying the flavorant 15 and the second flavorant 41 on the combustion type heat source 13.

According to the present embodiment, the protruding portion 14 includes the second flavorant 41 carried on the outer peripheral surface 32. According to this structure, in addition to the flavorant 15 carried on the distal end surface 28, the first chamfered portion 34, and the grooves 33, it is possible to further carry the second flavorant 41 on the outer peripheral surface 32. The second flavorant 41 carried on the outer peripheral surface 32 makes great contributions to an external flavor directly delivered to the user's nose. Thus, it is possible to realize the flavor inhaler 11 providing a richer smoking flavor, by increasing the area on which the flavorant 15 and the second flavorant 41 can be carried on the combustion type heat source 13.

In the present embodiment, the second flavorant 41 is same as the flavorant 15. According to this structure, it is possible to increase the area on which the flavorant 15 can be carried, and to realize the flavor inhaler 11 providing a richer smoking flavor.

In the present embodiment, the outer peripheral surface 32 includes the annular carriers 42 that carry the second flavorant 41. According to this structure, it is possible to easily change the amount of second flavorant 41, by changing the width of annular carriers 42 (the length with respect to the center axis C direction of the combustion type heat source 13), or changing the number of annular carriers 42. In the present embodiment, the annular carriers 42 all carry the same second flavorant 41, but they may carry flavorants different between the annular carriers 42 adjacent to each other.

According to the method of manufacturing the combustion type heat source 13 of the present embodiment, the second flavorant 41 different from the flavorant 15 is transferred to the outer peripheral surface 32 adjacent to the distal end surface 28 of the combustion material. According to this structure, it is possible to carry two types of flavorants 15 on the combustion type heat source 13 by the simple method. Moreover, for example, the flavorant 15 carried inside the grooves 33 can be used mainly as an internal flavor contained in the mainstream smoke, and the flavorant 15 carried on the distal end surface 28 and the outer peripheral surface 32 can be used mainly as an external flavor delivered directly to the user's nose. Thus, it is possible to also design a product in a precise manner in which use for each region of the combustion type heat source 13 is changed, and to realize the flavor inhaler 11 providing a smoking flavor having a sense of depth.

Seventh Embodiment

In the seventh embodiment, the combustion type heat source of the flavor inhaler 11 has the same appearance as that of the combustion type heat source 13 of the flavor inhaler 11 according to the sixth embodiment shown in FIG. 8. Thus, in the present embodiment, a description will be given below based on FIG. 8.

The combustion type heat source 13 in the seventh embodiment has the same shape as that in the first embodiment. In the present embodiment, the combustion type heat source 13 includes the flavorant 15 carried on the distal end surface 28 of the combustion type heat source 13, the flavorant 15 carried on the first chamfered portion 34, the flavorant 15 carried on the grooves 33, and the second flavorant 41 carried on the outer peripheral surface 32 of the combustion type heat source 13. In the seventh embodiment, unlike the sixth embodiment, the second flavorant 41 is different from the flavorant 15. That is, the flavorant 15 is composed of, for example, anethole. The second flavorant 41 is composed of, for example, limonene. The flavorant 15 may be flavorants other than anethole, and may be the flavorants described in the first embodiment. The second flavorant 41 may be flavorants other than limonene, and may be the flavorants described in the first embodiment. The flavorant 15 and the second flavorant 41 may be prepared by mixing a plurality of flavorants.

The amount of second flavorant 41 carried on the combustion type heat source 13 may be set to change along the radial direction of the combustion type heat source 13. That is, in the present embodiment, the largest amount of second flavorant 41 is carried on the outer peripheral surface 32. In this case, the amount of second flavorant 41 to be carried may not be uniform inside the combustion type heat source 13. The second flavorant 41 may be carried inside the combustion type heat source 13 so that the amount of flavorant 15 gradually decreases from the outer peripheral surface 32 toward the center axis C.

The method of carrying the flavorant 15 and the second flavorant 41 on the combustion type heat source 13 is the same as that in the sixth embodiment.

According to the present embodiment, the second flavorant 41 is different from the flavorant 15. According to this structure, it is possible to change types between the flavorant 15 carried on the grooves 33 of the combustion type heat source 13, and the second flavorant 41 carried on the outer peripheral surface 32. Thus, it is possible to realize a flavor prepared by mixing multiple types of flavorants, thereby increasing alternatives of the flavor combinations in designing the product. Moreover, it is possible to also design a product in a precise manner by utilizing the flavorant carried on the grooves 33 mainly as an internal flavor, utilizing the second flavorant 41 carried on the outer peripheral surface 32 mainly as an external flavor, etc. Thus, it is possible to realize the flavor inhaler 11 providing a smoking flavor having a sense of depth.

Eighth Embodiment

Figure 9:
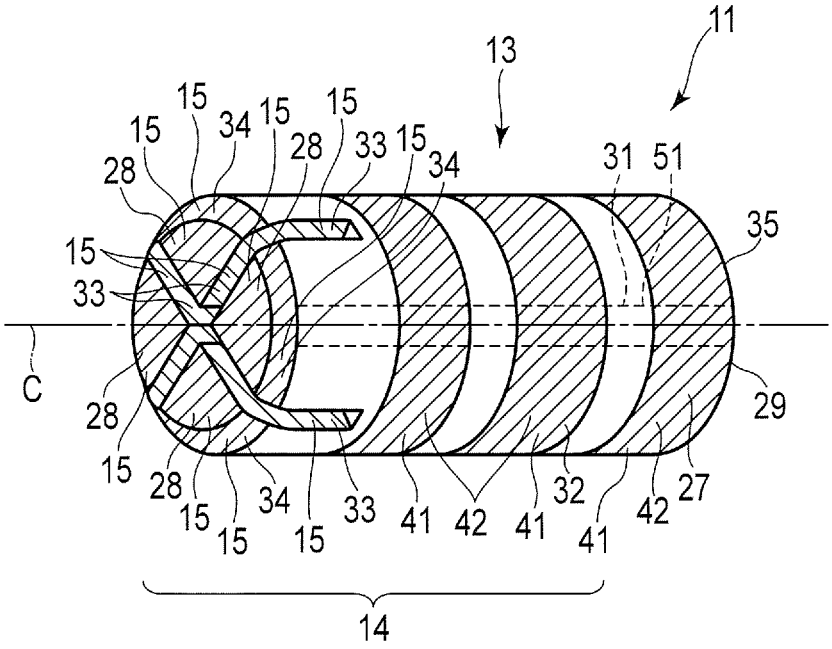
FIG. 9 is a perspective view showing the combustion type heat source of the flavor inhaler according to the eighth embodiment.

FIG. 9 shows the combustion type heat source of the flavor inhaler 11 according to the eighth embodiment. The combustion type heat source 13 has the same shape as that in the first embodiment. In the present embodiment, the flavorant 15 is carried on the distal end surface 28, the first chamfered portion 34, and the inner peripheral surface of the grooves 33 of the combustion heat source 13. The second flavorant 41 is carried on the outer peripheral surface 32 of the combustion type heat source 13. The third flavorant 51 is carried on the ventilation path 31 (an inner peripheral surface of the ventilation path 31).

In the eighth embodiment, the flavorant 15, the second flavorant 41, and the third flavorant 51 are different from each other. The flavorant 15 is composed of, for example, anethole, but may be flavorants other than anethole and may be the flavorants described in the first embodiment. The second flavorant 41 is composed of, for example, limonene, but may be flavorants other than limonene and may be the flavorants described in the first embodiment. The third flavorant 51 is composed of, for example, anisaldehyde, but may be flavorants other than anisaldehyde, and may be the flavorants described in the first embodiment.

The flavorant 15 may be the same as the second flavorant 41, or the third flavorant 51. The second flavorant 41 may be the same as the third flavorant 51. The flavorant 15, the second flavorant 41, and the third flavorant 51 may be prepared by mixing a plurality of flavorants.

The amount of second flavorant 41 carried on the combustion type heat source 13 may be set to change along the radial direction of the combustion type heat source 13. That is, in the present embodiment, the largest amount of second flavorant 41 is carried on the outer peripheral surface 32. In this case, the amount of second flavorant 41 to be carried may not be uniform inside the combustion type heat source 13. The second flavorant 41 may be carried inside the combustion type heat source 13 so that the amount of flavorant 15 gradually decreases from the outer peripheral surface 32 toward the center axis C.

The method of carrying the flavorant 15 on the distal end surface 28, the first chamfered portion 34, and the grooves 33 of the combustion type heat source 13 is the same as that in the fifth embodiment.

Figure 10:
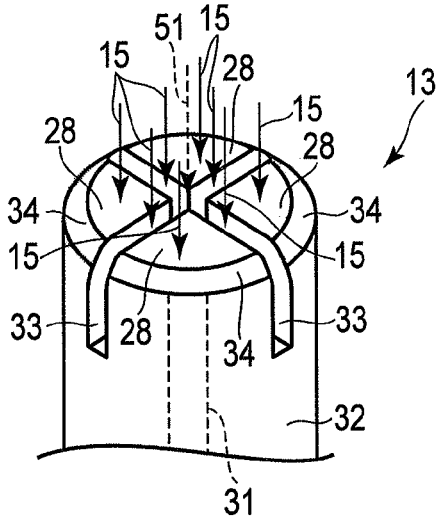
FIG. 10 is a perspective view showing the process of manufacturing the combustion type heat source of the flavor inhaler shown in FIG. 9.

For example, a nozzle may be disposed to face the distal end surface 28, and droplets of the liquid containing the flavorant 15 are discharged (dropped) from the nozzle as indicated by the arrows of the solid line in FIG. 10, causing the liquid containing the flavorant 15 to adhere to the distal end surface 28 and the first chamfered portion 34. In this case, in order to prevent the flavorant 15 from adhering to the surrounding area of the ventilation path 31, it is desirable to discharge droplets of the liquid containing the flavorant 15 at a position deviated from the ventilation path 31. As this liquid permeates into the combustion type heat source 13 from the distal end surface 28, the first chamfered portion 34, and the inner peripheral surface of the grooves 33, the flavorant 15 is carried in the vicinity of the distal end surface 28 and in the vicinity of the grooves 33. Alternatively, the flavorant 15 may be carried in the vicinity of the distal end surface 28 and in the vicinity of the grooves 33, by grasping the position on the proximal end surface 29 side of the outer peripheral surface 32 of the combustion type heat source 13, and then immersing the portion on the distal end surface 28 side of the combustion type heat source 13, until the distal end surface 28 and the grooves 33 are entirely soaked, into the liquid containing the flavorant 15 for a predetermined period of time.

The method of carrying the second flavorant 41 on the outer peripheral surface is the method of carrying the second flavorant 41 on the outer peripheral surface described in the second embodiment.

The third flavorant 51 is carried on the ventilation path 31 by, for example, the following method. That is, the nozzle is disposed so as to face the ventilation path 31, and droplets of a liquid containing the third flavorant 51 are discharged (dropped) from the nozzle as indicated by the arrow of the dashed line in FIG. 10. In this manner, the liquid containing the third flavorant 51 is caused to adhere to the inner peripheral surface of the ventilation path 31, and the liquid permeates into the combustion type heat source 13, thereby carrying the third flavorant 51 in the vicinity of the inner peripheral surface of the third flavorant 51. The discharge of the liquid containing the third flavorant 51 may be carried out simultaneously with the discharge of the liquid containing the flavorant 15, or may be carried out while shifting the time from the discharge of the liquid containing the flavorant 15.

According to the present embodiment, the protruding portion 14 includes the third flavorant 51 carried on the ventilation path 31. According to this structure, it is possible to contain the third flavorant 51 carried on the ventilation path 31 in the mainstream smoke, in addition to the flavorant 15 carried on the grooves 33. Thus, it is possible to increase the total weight of flavorants 15 and 51 carried on the combustion type heat source 13, and to realize the flavor inhaler 11 having a richer smoking flavor.

According to the present embodiment, the third flavorant 51 is different from the flavorant 15. According to this structure, it is possible to change types between the flavorant 15 carried on the grooves 33 of the combustion type heat source 13, and the third flavorant 51 carried on the ventilation path 31. Thus, it is possible to realize a flavor prepared by mixing multiple types of flavorants, thereby increasing alternatives of the flavor combinations in designing the product. Thereby, it is possible to realize the flavor inhaler 11 matching the user's preference.

In one modification of the present embodiment, the third flavorant 51 is the same as the flavorant 15. According to this structure, it is possible to increase the area of the portion on which the flavorant 15 is carried in the combustion type heat source 13, and to increase the total weight of flavorant 15 carried on the combustion type heat source 13. In the present embodiment, the third flavorant 51 is disposed on the ventilation path 31, and thus it is possible to add a flavor to the mainstream smoke in the most efficient manner. Thereby, it is possible to realize the flavor inhaler 11 having a richer smoking flavor.

The flavor inhaler 11 is not limited to the above-described embodiments and can be embodied in practice by modifying the structural elements without departing from the gist of the invention. For example, the shape of the holder 12 is not limited to a cylindrical shape, but may be, for example, a square tubular shape, or a tubular shape having other polygonal cross sections (hexagonal, octagonal, etc.). It is also possible to realize a flavor inhaler 11 by appropriately combining the constituent elements in the above-described different embodiments.

The applicant recognizes that the following matter is the invention as well.

A flavor inhaler, comprising:

a tubular holder that extends from a mouthpiece end to a distal end;

a flavor source that is provided in the holder; and a combustion type heat source that is provided at the distal end, and includes a protruding portion protruding from the distal end and a flavorant carried on the protruding portion, wherein the protruding portion comprises a chamfered portion, and the flavorant is carried on the chamfered portion.

The preferred embodiments are summarized below.

[1] A flavor inhaler, comprising:

a tubular holder that extends from a mouthpiece end toward a distal end;

a flavor source that is provided in the holder; and a combustion type heat source that is provided at the distal end, and includes a protruding portion protruding from the distal end and a flavorant carried on the protruding portion.

[2] The flavor inhaler according to [1], wherein the protruding portion comprises a distal end surface, and the flavorant is carried on the distal end surface.

[3] The flavor inhaler according to [2], wherein the protruding portion comprises an outer peripheral surface adjacent to the distal end surface, and a second flavorant carried on the outer peripheral surface.

[4] The flavor inhaler according to [3], wherein the second flavorant is a same as the flavorant.

[5] The flavor inhaler according to [3], wherein the second flavorant is different from the flavorant.

[6] The flavor inhaler according to any one of [3] to [5], wherein the outer peripheral surface comprises an annular carrier that carries the second flavor.

[7] The flavor inhaler according to [1], wherein the protruding portion comprises an outer peripheral surface, and the flavorant is carried on the outer peripheral surface.

[8] The flavor inhaler according to [1], wherein the protruding portion comprises a distal end surface, and an outer peripheral surface adjacent to the distal end surface, the combustion type heat source comprises:

a ventilation path that supplies air into the holder; and grooves that are recessed from at least one of the distal end surface and the outer peripheral surface, provided in the protruding portion, and communicate with the ventilation path, and the flavorant is carried on the grooves.

[9] The flavor inhaler according to [8], wherein the flavorant is carried on the distal end surface.

[10] The flavor inhaler according to [8] or [9], wherein the protruding portion comprises a second flavorant carried on the outer peripheral surface.

[11] The flavor inhaler according to [10], wherein the second flavorant is a same as the flavorant.

[12] The flavor inhaler according to [10], wherein the second flavorant is different from the flavorant.

[13] The flavor inhaler according to any one of [10] to [12], wherein the outer peripheral surface comprises an annular carrier that carries the second flavorant.

[14] The flavor inhaler according to any one of [8] to [13], wherein the ventilation path carries a third flavorant.

[15] The flavor inhaler according to [14], wherein the third flavorant is a same as the flavorant.

[16] The flavor inhaler according to [14], wherein the third flavorant is different from the flavorant.

[17] The flavor inhaler according to any one of [1] to [16], wherein the flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin.

[18] The flavor inhaler according to any one of [3] to [6] and [10] to [13], wherein the second flavorant contains at least one selected from the group consisting of anethole, 2-pinene, β-citronellol, linalyl acetate, limonene, anisaldehyde, 4-terpineol, 2-β-pinene, jasmone, sabinene, linalool, 1,8-cineole, phenethyl alcohol, and myristicin.

[19] The flavor inhaler according to any one of [14] to [16], wherein the third flavorant contains at least one selected from the group consisting of anethole, 2-pinene. β-citronellol, linalyl acetate, limonene, anisaldehyde, 4-terpineol, 2-β-pinene, jasmone, sabinene, linalool, 1,8-cineole, phenethyl alcohol, and myristicin.

[20] The flavor inhaler according to any one of [1] to [19], wherein the combustion type heat source has a cylindrical shape.

[21] The flavor inhaler according to any one of [1] to [20], wherein the combustion type heat source comprises a distal end surface, a proximal end surface that faces the distal end surface, and an outer peripheral surface that connects the distal end surface and the proximal end surface, wherein the distal end surface comprises a chamfered portion that is adjacent to the outer peripheral surface.

[22] The flavor inhaler according to any one of [1] to [21], wherein the flavorant is not carried on the proximal end surface of the protruding portion facing the distal end of the protruding portion.

[23] The flavor inhaler according to any one of [1] to [22], wherein the combustion type heat source contains activated carbon.

[24] The flavor inhaler according to [23], wherein the activated carbon is highly activated carbon.

[25] The flavor inhaler according to [23] or [24], wherein the activated carbon has a BET specific surface area of 1300 $m^2/g$ or more, and 2500 $m^2/g$ or less.

[26] The flavor inhaler according to any one of [23] to [25], wherein the combustion type heat source contains the activated carbon in an amount of 30 wt % or more, and 60 wt % or less.

[27] The flavor inhaler according to any one of [23] to [26], wherein the combustion type heat source contains the activated carbon in an amount of 30 wt % or more, and 45 wt % or less.

[28] The flavor inhaler according to any one of [1] to [27], further comprising a filter portion that is provided on the mouthpiece end side in the holder, and includes a flavorant capsule.

[29] The flavor inhaler according to [28], wherein menthol is encapsulated in the flavorant capsule.

[30] The flavor inhaler according to any one of [1] to [29], wherein the holder is a paper cylinder.

[31] The flavor inhaler according to any one of [1] to [30], further comprising aluminum adhering to an inner side of the holder.

[32] The flavor inhaler according to any one of [1] to [31], wherein the flavor source is a tobacco raw material.

[33] The flavor inhaler according to any one of [1] to [32], further comprising a cup for accommodating the flavor source therein, wherein the cup is inserted into the holder in a direction opening toward the distal end side, and comprises openings at a bottom.

[34] The flavor inhaler according to [33], wherein the cup is made of metal or paper.

[35] A method of manufacturing a combustion type heat source provided at a distal end of a tubular holder, the method comprising:

forming a combustion material comprising a distal end surface and grooves recessed from the distal end surface; and bringing a liquid containing a flavorant into contact with the combustion material to carry the flavorant on the distal end surface and the grooves.

[36] The method according to [35], wherein droplets of the liquid containing the flavorant adhere, from the distal end surface side, to the distal end surface of the combustion material and to the grooves.

[37] The method according to [35] or [36], wherein the combustion material has a porous structure.

[38] The method according to [36], wherein the liquid containing the flavorant adheres to the distal end surface and the grooves at a position deviated from a ventilation path formed to penetrate the combustion material.

[39] The method according to [35], wherein the distal end surface of the combustion material and the grooves are immersed into the liquid containing the flavorant.

[40] The method according to any one of [35] to [39], wherein a second flavorant different from the flavorant is transferred to an outer peripheral surface adjacent to the distal end surface of the combustion material.

The invention claimed is:

1. A flavor inhaler, comprising:

a tubular holder that extends from a mouthpiece end toward a distal end;

a flavor source that is provided in the holder; and a combustion type heat source that is provided at the distal end, and includes a protruding portion protruding from the distal end and a flavorant carried on the protruding portion of the combustion type heat source, wherein the combustion type heat source includes a distal end surface provided on the protruding portion, an outer peripheral surface adjacent to the distal end surface, a proximal end surface at a side of the flavor source and a second flavorant carried on the outer peripheral surface, the second flavorant extending inwardly toward a central axis of the combustion type heat source, and the combustion type heat source having a cylindrical shape, wherein a gradient of the flavorant carried on the protruding portion decreases from the distal end surface of the combustion type heat source toward the proximal end surface of the combustion type heat source, and wherein a gradient of the second flavorant carried on the outer peripheral surface decreases from the outer peripheral surface toward the central axis of the combustion type heat source.

2. The flavor inhaler according to claim 1, wherein the second flavorant is the same as the flavorant.

3. The flavor inhaler according to claim 1, wherein the second flavorant is different from the flavorant.

4. The flavor inhaler according to claim 1, wherein the outer peripheral surface comprises an annular carrier that carries the second flavorant.

5. The flavor inhaler according to claim 1, wherein the protruding portion comprises an outer peripheral surface, and the flavorant is carried on the outer peripheral surface.

6. The flavor inhaler according to claim 1, wherein the combustion type heat source comprises:

a ventilation path that supplies air into the holder; and grooves that are recessed from at least one of the distal end surface and the outer peripheral surface, provided in the protruding portion, and communicate with the ventilation path, wherein the flavorant is carried on the grooves.

7. The flavor inhaler according to claim 1, wherein the second flavorant is the same as the flavorant.

8. The flavor inhaler according to claim 1, wherein the second flavorant is different from the flavorant.

9. The flavor inhaler according to claim 1, wherein the outer peripheral surface comprises an annular carrier that carries the second flavorant.

10. The flavor inhaler according to claim 6, wherein the ventilation path carries a third flavorant.

11. The flavor inhaler according to claim 10, wherein the third flavorant is a same as the flavorant.

12. The flavor inhaler according to claim 10, wherein the third flavorant is different from the flavorant.

13. The flavor inhaler according to claim 1, wherein the combustion type heat source is activated carbon.

14. A method of manufacturing a combustion type heat source, the method comprising:

forming a combustion material comprising a distal end surface, an outer peripheral surface adjacent to the distal end surface, a proximal end surface and grooves recessed from the distal end surface;

a placing the combustion material in a tubular holder that extends from a mouthpiece end toward a distal end of a flavor inhaler;

bringing a liquid containing a flavorant into contact with the combustion material to carry the flavorant on the distal end surface and the grooves; and forming a second flavorant on the outer peripheral surface of the combustion material, the second flavorant extending inwardly toward a central axis of the combustion type heat source, wherein a gradient of the flavorant decreases from the distal end surface of the combustion material toward the proximal end surface of the combustion material, and wherein a gradient of the second flavorant carried on the outer peripheral surface decreases from the outer peripheral surface toward the central axis of the combustion material.

15. The method according to claim 14, wherein droplets of the liquid containing the flavorant adhere to the distal end surface of the combustion material and the grooves.

16. The method according to claim 14, wherein the combustion material has a porous structure.

17. The method according to claim 14, wherein the liquid containing the flavorant adheres to the distal end surface and the grooves at a position deviated from a ventilation path formed to penetrate the combustion material.

18. The method according to claim 14, wherein the distal end surface of the combustion material and the grooves are immersed into the liquid containing the flavorant.

* * * * *